United States Patent [19]

Robb et al.

[11] Patent Number: 4,617,139

[45] Date of Patent: Oct. 14, 1986

[54] DETERGENT COMPOSITIONS CONTAINING POLYMERS

[75] Inventors: Ian D. Robb, Hoylake; Peter M. Duggleby, Irby, both of England

[73] Assignee: Lever Brothers Company, New York, N.Y.

[21] Appl. No.: 789,588

[22] Filed: Oct. 21, 1985

[30] Foreign Application Priority Data

Aug. 12, 1984 [GB] United Kingdom ..... 8520184
Oct. 23, 1984 [GB] United Kingdom ..... 8426737

[51] Int. Cl.[4] ..... C11D 3/37

[52] U.S. Cl. ..... 252/135; 252/174.16; 252/174.24; 252/DIG. 2; 252/DIG. 15

[58] Field of Search ..... 252/135, 174.24, 174.16, 252/DIG. 2, 180, DIG. 15

[56] References Cited

U.S. PATENT DOCUMENTS

| | | | |
|---|---|---|---|
| 2,957,931 | 10/1960 | Hamilton et al. | 252/174.16 |
| 3,284,364 | 11/1966 | Siegele | 252/174.24 |
| 3,558,499 | 1/1971 | Galvin et al. | 252/174.24 |
| 3,684,779 | 8/1972 | Rapko | 252/174.24 |
| 4,046,707 | 9/1977 | Smith et al. | 252/180 |
| 4,105,551 | 8/1978 | Smith et al. | 252/180 |
| 4,127,483 | 11/1978 | Smith et al. | 252/180 |
| 4,159,946 | 7/1979 | Smith et al. | 252/180 |
| 4,372,870 | 2/1983 | Snyder et al. | 252/180 |
| 4,563,284 | 1/1986 | Amjad | 210/699 |

FOREIGN PATENT DOCUMENTS

| | | |
|---|---|---|
| 2921374 | 12/1979 | Fed. Rep. of Germany . |
| 935733 | 9/1963 | United Kingdom . |
| 1269848 | 4/1972 | United Kingdom . |
| 1290724 | 9/1972 | United Kingdom . |
| 1458235 | 12/1976 | United Kingdom . |
| 1460893 | 1/1977 | United Kingdom . |
| 1551239 | 8/1979 | United Kingdom . |
| 1595688 | 8/1981 | United Kingdom . |

OTHER PUBLICATIONS

"Belsperse 161", (previously known as Chel 3229), Technical Information Bulletin, dated Apr. 1983.

"Polymer Additives", Rohm and Haas Co. 1981, Dec., pp. 1–10.

*Primary Examiner*—Prince E. Willis

*Attorney, Agent, or Firm*—Milton L. Honig; James J. Farrell

[57] ABSTRACT

A detergent composition comprising a detergent-active compound and an anti-redeposition polymer formed by reacting (1) an ethylenic compound of the general formula:

$$CHR{=}CR'CO_2H$$

in which

R may be a hydrogen atom, a carboxyl residue or, together with the carboxyl group on the adjacent carbon atom, may be an anhydride, R′ may be a hydrogen atom or a methyl or ethyl residue, with a reducing phosphorus-containing compound of the general formula:

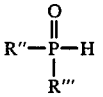

in which

R″ may be a hydrogen atom, a straight- or branched-chain alkyl residue having from 1 to 18 carbon atoms, a cycloalkyl residue having from 5–12 carbon atoms, an aryl group, an alkaryl group or a radical of the general formula OX, wherein X may be a hydrogen atom or a straight- or branched-chain alkyl group having from 1 to 4 carbon atoms, and R‴ is a radical of the general formula OX wherein X has the significance defined above.

The polymer or mixtures of polymers useful in the detergent composition as an anti-redeposition aid have a ratio of acrylic acid or equivalent monomer, i.e. ethylenic compound monomer, to reducing phosphorus-containing compound of from 10:1 to 60:1, preferably from 12:1 to 35:1.

7 Claims, No Drawings

DETERGENT COMPOSITIONS CONTAINING POLYMERS

This invention relates to detergent compositions containing polymers and more particularly to fabric-washing detergent compositions containing small amounts of organic polymers for prevention of redeposition of soil.

Redeposition of soil removed from washed articles back onto the articles themselves is a well-known problem which is of particular significance with fabrics articles, and many solutions have been suggested to it. Classically, sodium carboxymethylcellulose was incorporated into fabric-washing compositions, and that compound is still used to-day. More recently, copolymers of ethylene or vinyl methyl ether and maleic anhydride, copolymers of acrylic acid and maleic anhydride and homopolymers of acrylic acid have been suggested in the patent literature (see Procter and Gamble's GB No. 1 269 848 and Unilever's GB No. 1 460 893) and used to some considerable extent in practice.

We have now discovered that a new group of polymers have useful anti-redeposition effects and reduce fabric ashing when used in fabric-washing detergent compositions. The new group of polymers has the further advantage that it can aid in the structuring of detergent powder compositions and the dispersibility thereof.

Accordingly, the present invention provides a detergent composition comprising a detergent-active compound and an anti-redeposition polymer formed by reacting:

an ethylenic compound of the general formula:

$$CHR{=}CR'CO_2H$$

in which

R may be a hydrogen atom, a carboxyl residue or, together with the carboxyl group on the adjacent carbon atom, may be an anhydride.

R′ may be a hydrogen atom or a methyl or ethyl residue, with a reducing phosphorus-containing compound of the general formula:

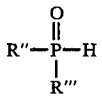

in which

R″ may be a hydrogen atom, a straight- or branched-chain alkyl residue having from 1 to 18 carbon atoms, a cycloalkyl residue having from 5–12 carbon atoms, an aryl group, an alkaryl group or a radical of the general formula OX, wherein X may be a hydrogen atom or a straight- or branched-chain alkyl group having from 1 to 4 carbon atoms, and R‴ is a radical of the general formula OX wherein X has the significance defined above.

The polymers formed by this reaction are thought to have the general formula:

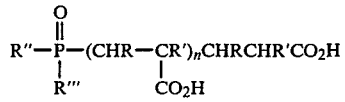

(I)

when

R″ is other than a hydrogen atom; and where

R″ is a hydrogen atom, a mixture of a polymer of the above formula and one of the general formula:

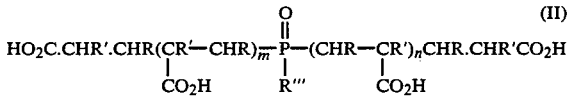

(II)

wherein R, R′ and R‴ have their previous significance, and m and n are integers.

Alternatively, the carboxyl group in the above formulae may also possibly be bound to the C atom adjacent to the P atom.

Polymers of the type described are disclosed in British Pat. Nos. 1 458 235 and 1 595 688 (Ciba-Geigy), where they are suggested as scale-inhibitors for use in industrial situations, e.g. industrial boilers, steam power plants, cooling water systems and water desalination. However, it has been discovered that only a limited range of the disclosed polymers is suitable for use in detergent compositions as an effective anti-redeposition aid for improving the whiteness or brightness retention of fabrics. That range is where the ratio of acrylic acid or equivalent monomer, i.e. ethylene compound monomer, to reducing phosphorus-containing compound is from 10:1 to 60:1, preferably from 12:1 to 35:1; polymers outside this range and particularly having the ratio below 10:1 being much less effective anti-redeposition agents.

Preferably, each of R, R′ and R″ represent hydrogen atoms and R‴ represents OH. The polymers may be added to compositions either in the acid form or in the form of a salt such as sodium salt. However, the preponderance of sodium ion in detergent compositions is such that in use the polymer will inevitably be present as the sodium salt.

The polymers of the invention may be incorporated in detergent compositions either by admixing them with other components of the aqueous crutcher slurry and spray-drying or by adding them to the composition after the spray-drying step with heat-sensitive components such as sodium perborate.

The amount of the polymer to be incorporated into a detergent composition to obtain anti-redeposition effects will be from 0.1 to 10%, preferably 0.5 to 3% by weight of the composition.

The polymers may also be incorporated in liquid detergent compositions.

The precise chemical nature of the detergent compositions into which the polymers are incorporated is not especially critical, since the anti-redeposition effect in a general one. The compositions will always contain a detergent-active substance and normally a detergency builder compound too. The remaining components will depend upon whether the composition is a liquid or a powder. The amount of detergent-active compound present in the composition will normally be in the range of about 3 to 50% by weight, though higher amounts may also be possible if the composition is presented in the form of a non-aqueous liquid detergent composition.

The present invention is, however, of particular benefit to detergent compositions having a reduced phosphate builder content, e.g. up to 25%, particularly less than 20% by weight of sodium tripolyphosphate. When the detergent composition is a powder, the polymer added to the aqueous detergent slurry before spray-drying will also act as a structurant, which is important in cases wherein sodium tripolyphosphate and/or sodium silicate is present at inadequate levels for proper structuring.

If it is a liquid, it may well be that the detergency builder compound is absent, since large quantities of inorganic materials can lead to physical destabilisation. Such compositions will normally contain anionic and nonionic surfactants, possibly a hydrotrope or cosolubiliser and minor components such as antioxidants, fluorescers, colourants and perfumes. However, it is perfectly feasible to incorporate detergency builders into liquid compositions if care is taken with solubility properties. It may be necessary in some instances to use the more soluble salts such as potassium and triethanolammonium salts for example. The builder compound may be either dissolved in the liquid medium or, if the medium is structured, suspended in it.

When the detergent composition is a powder it will normally be formulated in the conventional two-part form, a first part, which is produced by spray-drying, consisting of anionic and any nonionic and/or cationic surfactants, the detergency builder, sodium silicate as a powder structurant and corrosion inhibitor and the heat-stable minor components such as anti-redeposition agents, including the polymers suggested in this invention, anti-oxidants and fluorescers. Less heat-stable compounds such as oxygen bleaches (sodium perborate mono- and/or tetrahydrates, and sodium percarbonate), bleach precursors such as tetra-acetylethylenediamine and sodium nonanoyloxybenzene sulphone, enzymes and perfumes are admixed with the spray-dried part to form a single homogeneous powdered composition.

The nature of the anionic detergent-active compound used in the compositions of the invention is not critical. The compound can be any surface-active material which is suitable for use in detergent formulations. Examples of such materials are primary and secondary alkyl sulphate salts, secondary alkane sulphonate salts, olefin sulphonate salts and alkylaryl sulphonate salts, especially the sodium salts of these compounds, and soaps, that is to say salts of fatty acids derived from naturally-occurring materials. The anionic detergent-active compound will normally be present in the detergent compositions of the invention in an amount of from about 3–30% by weight of the composition, desirably about 5–15% by weight. Compositions containing more than about 30% by weight of anionic detergent-active component are difficult to process and are also too costly to be commercially viable.

The compositions of the invention may also contain a nonionic surfactant and usually will do so. The nonionic surfactants which are preferred for reasons of cost-effectiveness and environmental safety are the ethoxylated alcohols, although other nonionic surfactants such as long-chain alkanolamides may also be used. Preferred alcohol ethoxylates are the $C_6$–$C_{22}$ primary and secondary alcohols ethoxylated with from 5 to 25 moles of ethylene oxide per mole of alcohol. Nonionic surfactants may be present in the compositions in amounts of from about 3 to about 20% by weight when present alone to about 1 to about 15% by weight when in the presence of anionic surfactants.

When the compositions contain a detergency builder it is preferred that it should be a carbonate, especially sodium carbonate, or an orthophosphate, a pyrophosphate, a tripolyphosphate or a mixture thereof. Particularly preferred phosphate builders are a mixture of sodium tripolyphosphate and sodium orthophosphate. However, other organic or inorganic precipitant or sequestrant builders may be used either alone, or in admixture and either with or without phosphate builders. Examples of these are alkali metal amine carboxylates, such as sodium nitrilotriacetate and sodium ethylenediamine tetraacetate, alkali metal ether carboxylates, such as sodium oxydiacetate, sodium carboxymethyloxysuccinate, sodium carboxymethyloxymalonate and homologues thereof, alkali metal citrates, alkali metal mellitates and salts of polymeric carboxylic acids, such as sodium polymaleate, copolyethylenemaleate, polyitaconate and polyacrylate. When sodium carbonate is used as a detergency builder, it is advantageous to have present some calcium carbonate having a surface area of at least about 10 $m^2/g$, as described in U.K. Pat. No. 1 437 950.

Another type of detergency builder which can be used, either alone or in admixture with other builders, is a cation exchange material, especially a sodium alumino-silicate such as described in U.K. Pat. No 1 429 143 or in Netherlands Patent Application No. 7403381. Preferred materials of this type have the formula:

$$(Na_2O)_{0.7\text{-}1.1}.Al_2O_3(SiO_2)_{1.3\text{-}3.3}$$

and may be amorphous or crystalline, with some bound water usually in an amount of about 10–30% depending on the drying conditions used. Such sodium aluminosilicate materials should, of course, be very finely divided so as to minimise deposition on the fabrics during washing.

Lately there is a growing trend (due to legislation to a number of countries) to reduce the levels of, or replace completely sodium tripolyphosphate in fabric-washing products. One of the consequences of this is a loss of some of the valuable secondary effects of sodium tripolyphosphate, which include control of soil redeposition and fabric ash, powder structuring and powder dispersibility.

All of these can, to a certain degree, be helped by the use of the present polymers.

If water-insoluble aluminosilicate cation-exchange materials, such as zeolites, are used to replace sodium tripolyphosphate wholly or partially, the presence of higher levels of sodium silicate (as corrosion inhibitor and/or structurant) could present problems with respect to the formation of insoluble material being deposited onto the fabrics. In order to overcome this problem the alkali metal silicate level in such formulations is normally kept at below a certain level, i.e. not more than about 4% by weight. This will have the consequence that the level of sodium silicate becomes inadequate to provide proper structuring of the powder. In this case the use of the polymers according to the invention can also help to compensate the reduced silicate level as a structuring aid.

The present invention is therefore also of particular benefit as anti-redeposition aid in powder compositions containing less than about 4% by weight of alkali metal silicate materials.

The total amount of the detergency builder which is used in the composition as a whole is normally from about 10% up to about 60% by weight of the composition, preferably about 15% to about 50%, and the ratio by weight of the detergency builders to the detergent-active compounds which are used is generally from about 3:1 to about 1:2 parts by weight.

The detergent compositions of the invention may also include any of the conventional optional additives in addition to those already mentioned in the amounts usually employed in detergent compositions. Examples of these additives include lather controllers, polymers other than the present polymers, including the well-known homopolymers of acrylic acid or its salts, chlorine-releasing bleaching agents such as trichloroisocyanuric acid and alkali metal salts of dichloroisocyanuric acid, fabric-softening agents such as quaternary ammonium salts, anti-ashing aids, starches, inorganic salts such as sodium silicates and sodium sulphate and, usually present in very minor amounts, fluorescent agents, perfumes, enzymes such as proteases and amylases, germicides and colourants. The detergent compositions usually have an alkaline pH, generally in the region of pH 9–11, which is achieved by the presence of alkaline salts, especially sodium silicates such as the meta-, neutral or alkaline silicates, preferably at levels up to about 15% by weight.

The invention is illustrated by the following Examples in which parts and percentages are by weight except where otherwise indicated.

EXAMPLE I

In a single experiment, the anti-redeposition effect of three comparable formulations containing different polymers were investigated. First, solutions containing 4 g/liter of the detergent compositions shown below in water of 40° French hardness were prepared.

| | % by weight |
|---|---|
| Sodium dodecylbenzene sulphonate | 6.0 |
| $C_{14-15}$ 11 EO nonionic surfactant | 2.0 |
| Hardened sodium stearate | 3.0 |
| Sodium tripolyphosphate | 7.5 |
| Sodium orthophosphate | 7.5 |
| Sodium alkaline silicate | 7.0 |
| Sodium perborate | 20.0 |
| Sodium sulphate | 20.0 |
| Sodium carboxymethylcellulose | 0.5 |
| Polymer (see Table 1) | 1.0 |
| Water up to | 100.0 |

The three formulations tested were derived from the composition shown above by addition of the components shown in Table 1.

TABLE 1

| | % by weight Formulation: | | |
|---|---|---|---|
| Polymer Added | A | B | C |
| None | Nil | | |
| Dry acrylic acid/maleic acid copolymer (*Sokalan CP5 ex BASF) | | 1 | |
| Dry acrylic acid/hypophosphorous acid copolymer (16:1) (*CHEL 3229 ex Ciba-Geigy) | | | 1 |

*Registered Trade Mark

Each of these three compositions was used to wash white cotton monitors in the presence of standard EMPA 101 (Indian ink/olive oil) solid detergency test cloths in Tergotometers ®. The was conditions were:

Temperature: 60° C.
Wash time: 20 minutes
Flood time: 5 minutes
Rinse time: 2 1-minute rinses This wash operation was performed six times and after each wash cycle the change in reflectance of the cotton monitors was measured by standard techniques. The results are shown in Table 2.

TABLE 2

| Change in Reflectance of Cotton Monitors (ΔR) | | | | | | |
|---|---|---|---|---|---|---|
| | Wash Cycle | | | | | |
| Formulation | 1 | 2 | 3 | 4 | 5 | 6 |
| A | 14.6 | 17.3 | 18.7 | Not measured | 21.8 | 23.0 |
| B | 9.0 | 10.8 | 12.7 | Not measured | 16.1 | 16.5 |
| C | 1.9 | 2.2 | 3.2 | Not measured | 4.6 | 5.3 |

It can be seen that the change in reflectance of the cotton monitor washed with formulation C, the formulation in accordance with the invention, is lower than either the control formulation A containing no anti-redeposition polymer other than sodium carboxymethyl-cellulose (SCMC), or formulation B containing both SCMC and Sokalan CP5 ®, which probably represents the best combination presently known to the detergents art.

EXAMPLE II

In multiple Tergotometer ® wash experiments the effectiveness of three different polymers in preventing the redeposition of soil resulting from differently soild test cloths and from article pieces (cut from soiled tea towels) was compared, using the following basic detergent powder formulation at a dosage of 4 g/l.

| | % by weight |
|---|---|
| Sodium dodecylbenzene sulphonate | 9.0 |
| $C_{13-15}$ alcohol/7 ethylene oxide nonionic surfactant | 4.0 |
| Sodium tripolyphosphate (STP) | 25.0 |
| Sodium carbonate | 5.0 |
| Sodium alkaline silicate | 6.0 |
| Sodium carboxymethylcellulose | 0.5 |
| Sodium sulphate | 25.0 |
| Sodium perborate 4 $H_2O$ (post dosed) | 15.0 |
| Polymer* | 1.0 |
| Water up to | 100.0 |

% STP breakdown during manufacture 30%.
*Polymer (a) = Dry acrylic acid/hypophosphorous acid copolymer (25:1)
Polymer (b) = Commercial polyacrylate (Natrol ® 34)
Polymer (c) = Dry acrylic acid/maleic acid copolymer (Sokalan ® CP5 ex BASF).

The wash conditions were the same as those used in Example I.

Table 3 below ranks the order of effectiveness of the polymers, the most effective first, after 3, 6 and 9 washes. The indication > signifies that the polymers on the left are much better than those on the right.

TABLE 3

| | Number of washes | | |
|---|---|---|---|
| Cloth soiled with: | 3 | 6 | 9 |
| 1. Indian ink/groundnut oil/iron oxide | b a c | a b c | |
| 2. Indian ink/groundnut oil/iron oxide | c a>b | a>b>c | |
| 3. Indian ink/groundnut | a b c | b a c | |

TABLE 3-continued

| Cloth soiled with: | Number of washes 3 | 6 | 9 |
|---|---|---|---|
| oil/iron oxide/milk powder | | | |
| 4. EMPA 101 (Indian ink/olive oil) | a b>c | c b a | |
| 5. EMPA 116 (Indian ink/milk/blood) | b a>c | a b c | |
| 6. VCD (Vacuum cleaner dust) | a>b c | a>b c | |
| 7. Lanolin/kaolin/carbon black/iron oxide) | a>b c | a>b c | |
| 8. Clay/candy black | a c>b | a c>b | |
| 9. Article pieces | a>b>c | a>b>c | a>b>c |

It can be seen that overall the formulation with polymer (a) according to the invention is superior to the other formulations containing polymer (b) or polymer (c).

EXAMPLE III

Another series of experiments was made to compare the anti-redeposition effects of polymer (a), polymer (b) and polymer (c) in the formulation of Example II, using dirty wash liquor as a source of soil. In an attempt to obtain a homogeneous supply of "real" soil, laundry loads were washed in a twin-tub washing machine and the resulting dirty wash liquor was used as a source of soil in subsequent Tergotometer® deposition experiments under the following wash conditions:

Temperature: 60° C.
Wash time: 20 minutes
Flood time: 5 minutes
Rinse time: two 1-minute rinses
Soiled wash liquor adjusted to: 40° French hardness
Polymer added: at 1% of product.

Preparation of wash liquor

4×2.5 kg soiled loads were washed consecutively for 20 minutes at 80° C. in the same 35 liters of demineralised water with the same base product without polymer to be used in the Tergotometer® experiments at a product dosage of 4 g/l.

The results of the Tergotometer® deposition experiments depicted in Table 4 show changes in Reflectance (−ΔR) of the white cotton monitors:

TABLE 4

| Exp. N° | Number of Washes | (−ΔR) Without Polymer 0 | Polymer (a) 0.5% | Polymer (a) 1% | Polymer (b) 1% | Polymer (c) 1% |
|---|---|---|---|---|---|---|
| 1 | 4 | 3.1 | — | 1.7 | — | 2.3 |
| | 8 | 4.7 | — | 2.5 | — | 3.6 |
| | 12 | 4.9 | — | 2.1 | — | 4.2 |
| 2 | 4 | 2.9 | — | 2.2 | — | 2.4 |
| | 8 | 5.1 | — | 3.8 | — | 4.3 |
| | 12 | 6.4 | — | 4.6 | — | 5.1 |
| 3 | 4 | 3.3 | 0.8 | 0.9 | 1.3 | 1.7 |
| | 8 | 5.1 | 2.7 | 2.1 | 2.5 | 3. |

Each horizontal line of −ΔR values was obtained from one batch of soiled liquor, a different batch being used for each subsequent set of 4 washes. Comparisons between the effect of various polymers, wash compositions, etc. are only legitimate within one experiment. Comparisons should not be made between different experiments because of the different batches of wash liquor used.

The above data show that polymer (a) used according to the invention is the most effective as compared with polymer (b)—a polyacrylate—and polymer (c)—an acrylic acid/maleic acid copolymer.

EXAMPLE IV

A series of Tergotometer® evaluations was carried out to compare the effectiveness of acrylic acid/hypophosphorous acid copolymer (25:1), i.e. polymer (a) of Example II, with that of Sokalan CP5 ex BASF, i.e. polymer (c) of Example II, in a normal anionic/nonionic formulation containing various builder systems.

Wash conditions:
Product dosage: 4 g/l
Temperature: 60° C.
Wash time: 20 minutes
Flood time: 5 minutes
Rinse time: 2×1-minute rinses
Soil cloth: EMPA 101 (Indian ink/olive oil)
Redeposition monitor: combined white cotton
Polymer level
in product: 1%

The change of reflectance of cotton monitors read after 6 washes is shown in the following Table 5.

TABLE 5

| Builder system in Product | | Polymer nil | (a) | (c) |
|---|---|---|---|---|
| A | 18% sodium tripolyphosphate | 9.1 | 7.7 | 10.2 |
| | 13% zeolite A | 5.4 | 4.0 | 4.1 |
| B | 30% sodium carbonate, 20% calcite | 13.1 | 7.1 | 9.1 |

Again, the above results clearly show that the change in reflectance of the cotton monitors washed with formulations containing polymer (a), the formulation of the invention, is lower than that of the cotton monitors washed with formulations containing polymer (c) outside the invention.

EXAMPLE V

In this Example the effect of polymer level in a detergent powder composition on the redeposition of soil was examined in a Tergotometer® wash experiment.

The detergent powder composition was basically the same as that used in Example I, wherein the level of polymer (in the present case dry acrylic acid/hypophosphorous acid copolymer of ratio 25:1) was varied from 0 to 1.4% by weight, which was compensated by the sodium sulphate level.

Wash conditions:
Temperature: 60° Cl
Wash time: 20 minutes
Flood time: 5 minutes
Rinse time: 2×1 minute
Soil cloth: EMPA 101
Redeposition monitor: combed white cotton
Product dosage: 4 g/l
Water hardness: 40° French hardness The results are shown in Table 6 below.

TABLE 6

| % polymer | 0 | 0.5 | 0.8 | 1.1 | 1.4 |
|---|---|---|---|---|---|
| ΔR after 3 washes | 18.5 | 11.4 | 8.0 | 5.6 | 5.3 |

EXAMPLE VI

Experiments were conducted on redeposition early in the wash. In the early stages of a wash, product concentrations are low because of the finite rate of solution of product ingredients and because of the mechanical loss of powder in the sump of the washing machine. In the present Tergotometer ® experiments 1 g/l of product was used with a polymer content of 3% by weight. This was to simulate the beginning of a wash nominally at 5 g/l (European conditions) with 1% of polymer but when only 1 g/l of product had dissolved together with a higher proportion of the polymer. The wash time was set at 5 minutes.

Polymer (a) of Example II (MW 6200) was compared with a polyacrylate of approximately the same molecular weight (MW 6100) in a base product formulation of Example II containing 23% of sodium tripolyphosphate.

The results are given in the following Table 7, showing change in reflectance (−ΔR) of cotton monitors after 3 washes.

TABLE 7

| (−ΔR) after 3 washes | | |
|---|---|---|
| No Polymer | + Polymer (a) | + Polyacrylate |
| 11.9 | 5.9 | 7.5 |
| 11.6 | 6.3 | 7.1 |
| 11.2 | 7.0 | 8.8 |
| 10.7 | 6.5 | 8.1 |

The results again show superiority of the product with polymer (a) of the invention to the product containing polyacrylate outside the invention.

We claim:

1. A detergent composition comprising from 3 to 50% by weight of a detergent-active compound selected from the group consisting of anionic, nonionic and cationic surfactants and mixtures thereof, from 0 to 60% by weight of a detergency builder and from 0.1 to 10% by weight of an anti-redeposition polymer, said polymer being one having the general formula:

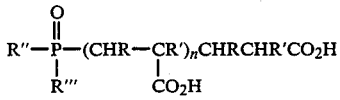

wherein

R is a group selected from hydrogen, a carboxyl radical, an anhydride formed from said carboxyl radical and from the carboxyl radical on the adjacent carbon atom in said formula, and combinations thereof;

R′ is a group selected from hydrogen, methyl or ethyl radical, and combinations thereof;

R″ is a group selected from hydrogen, straight- or branched-chain alkyl radical having from 1 to 18 carbon atoms, cycloalkyl radical having from 5–12 carbon atoms, an aryl radical, an alkaryl radical and a radical of the general formula OX, wherein X may be a hydrogen atom or a straight- or branched-chain alkyl radical having from 1 to 4 carbon atoms;

R‴ is a radical of the general formula OX, wherein X is defined as above; and n is an integer, but when R″ is hydrogen, then the polymer is a mixture of a polymer of the above formula and one of the general formula:

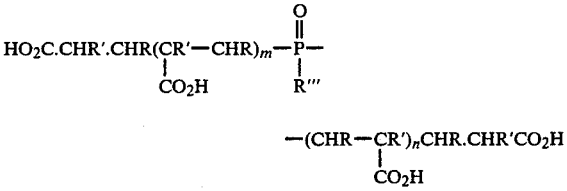

wherein R, R′ and R‴ have their previous significance, and m and n are integers, such as the ratio of the CHR—CR′($CO_2H$) unit to the phosphorus atom is from 10:1 to 60:1.

2. A detergent composition according to claim 1, wherein said ratio is from 12:1 to 35:1.

3. A detergent composition according to claim 1, wherein said anti-redeposition polymer is present in an amount of 0.5 to 3% by weight of the total composition.

4. A detergent composition according to claim 1, which comprises from 10 to 60% by weight of a detergency builder.

5. A detergent composition according to claim 4, which comprises up to 25% by weight of a phosphate builder.

6. A detergent composition according to claim 5, comprising less than 20% by weight of sodium tripolyphosphate.

7. A detergent composition according to claim 1, containing an alkali metal silicate in an amount of less than about 4% by weight of the total composition.

* * * * *